US005961017A

United States Patent [19]

Mehler

[11] Patent Number: 5,961,017

[45] Date of Patent: Oct. 5, 1999

[54] BACKPACK

[76] Inventor: Edward W. Mehler, 502 Canal St., Lebanon, Pa. 17046

[21] Appl. No.: 09/074,089

[22] Filed: May 7, 1998

[51] Int. Cl.[6] ..... A45F 4/00

[52] U.S. Cl. ..... 224/576; 224/153; 224/257; 224/582; 224/583; 224/916

[58] Field of Search ..... 224/576, 575, 224/153, 582, 583, 916, 913, 257, 250, 251, 255, 645, 652, 901.2, 901.4, 901.6; 190/102, 103, 105, 108, 110

[56] References Cited

U.S. PATENT DOCUMENTS

| | | | |
|---|---|---|---|
| 37,893 | 3/1863 | Baxter | 224/635 |
| 42,895 | 5/1864 | Woods | 224/651 |
| D. 316,177 | 4/1991 | Strimpfel | D3/217 |
| 4,389,735 | 6/1983 | McLaughlin | 2/94 |
| 5,018,609 | 5/1991 | Brenner | 190/108 |
| 5,412,545 | 5/1995 | Rising | 360/105 |
| 5,567,055 | 10/1996 | Smith | 383/38 |
| 5,586,706 | 12/1996 | Ritzenhein | 224/151 |
| 5,628,443 | 5/1997 | Deutsch | 224/583 |
| 5,791,537 | 8/1998 | Miller | 224/583 |

*Primary Examiner*—Allan N. Shoap
*Assistant Examiner*—Maerena W. Brevard

[57] ABSTRACT

A new backpack for carrying supplies while in the wilderness. The inventive device includes a main compartment with a pair of shoulder straps. A flashlight is detachably attached to one of the shoulder straps. A quiver is detachably attached to one of the sides of the main compartment. A gear bag is detachably attached to another side of the main compartment.

13 Claims, 2 Drawing Sheets

BACKPACK

BACKGROUND OF THE INVENTION

1. Field of the Invention

The present invention relates to backpacks and more particularly pertains to a new backpack for carrying supplies while in the wilderness.

2. Description of the Prior Art

The use of backpacks is known in the prior art. More specifically, backpacks heretofore devised and utilized are known to consist basically of familiar, expected and obvious structural configurations, notwithstanding the myriad of designs encompassed by the crowded prior art which have been developed for the fulfillment of countless objectives and requirements.

Known prior art backpacks include U. S. Pat. No. 3,973,776; U.S. Pat. No. 4,073,328; U.S. Pat. No. 5,409,109; U.S. Pat. No. 4,754,904; U.S. Pat. No. Des. 316,177; and U.S. Pat. No. 4,776,503.

While these devices fulfill their respective, particular objectives and requirements, the aforementioned patents do not disclose a new backpack. The inventive device includes a main compartment with a pair of shoulder straps. A flashlight is detachably attached to one of the shoulder straps. A quiver is detachably attached to one of the sides of the main compartment. A gear bag is detachably attached to another side of the main compartment.

In these respects, the backpack according to the present invention substantially departs from the conventional concepts and designs of the prior art, and in so doing provides an apparatus primarily developed for the purpose of carrying supplies while in the wilderness.

SUMMARY OF THE INVENTION

In view of the foregoing disadvantages inherent in the known types of backpacks now present in the prior art, the present invention provides a new backpack construction wherein the same can be utilized for carrying supplies while in the wilderness.

The general purpose of the present invention, which will be described subsequently in greater detail, is to provide a new backpack apparatus and method which has many of the advantages of the backpacks mentioned heretofore and many novel features that result in a new backpack which is not anticipated, rendered obvious, suggested, or even implied by any of the prior art backpacks, either alone or in any combination thereof.

To attain this, the present invention generally comprises a main compartment with a pair of shoulder straps. A flashlight is detachably attached to one of the shoulder straps. A quiver is detachably attached to one of the sides of the main compartment. A gear bag is detachably attached to another side of the main compartment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new backpack apparatus and method which has many of the advantages of the backpacks mentioned heretofore and many novel features that result in a new backpack which is not anticipated, rendered obvious, suggested, or even implied by any of the prior art backpacks, either alone or in any combination thereof.

It is another object of the present invention to provide a new backpack which may be easily and efficiently manufactured and marketed.

It is a further object of the present invention to provide a new backpack which is of a durable and reliable construction.

An even further object of the present invention is to provide a new backpack which is susceptible of a low cost of manufacture with regard to both materials and labor, and which accordingly is then susceptible of low prices of sale to the consuming public, thereby making such backpack economically available to the buying public.

Still yet another object of the present invention is to provide a new backpack which provides in the apparatuses and methods of the prior art some of the advantages thereof, while simultaneously overcoming some of the disadvantages normally associated therewith.

Still another object of the present invention is to provide a new backpack for carrying supplies while in the wilderness.

Yet another object of the present invention is to provide a new backpack which includes a main compartment with a pair of shoulder straps. A flashlight is detachably attached to one of the shoulder straps. A quiver is detachably attached to one of the sides of the main compartment. A gear bag is detachably attached to another side of the main compartment.

Still yet another object of the present invention is to provide a new backpack that includes a detachable quiver for carrying arrow bow hunters using the backpack.

Even still another object of the present invention is to provide a new backpack that detachable secondary bag for carrying extra gear on the backpack.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
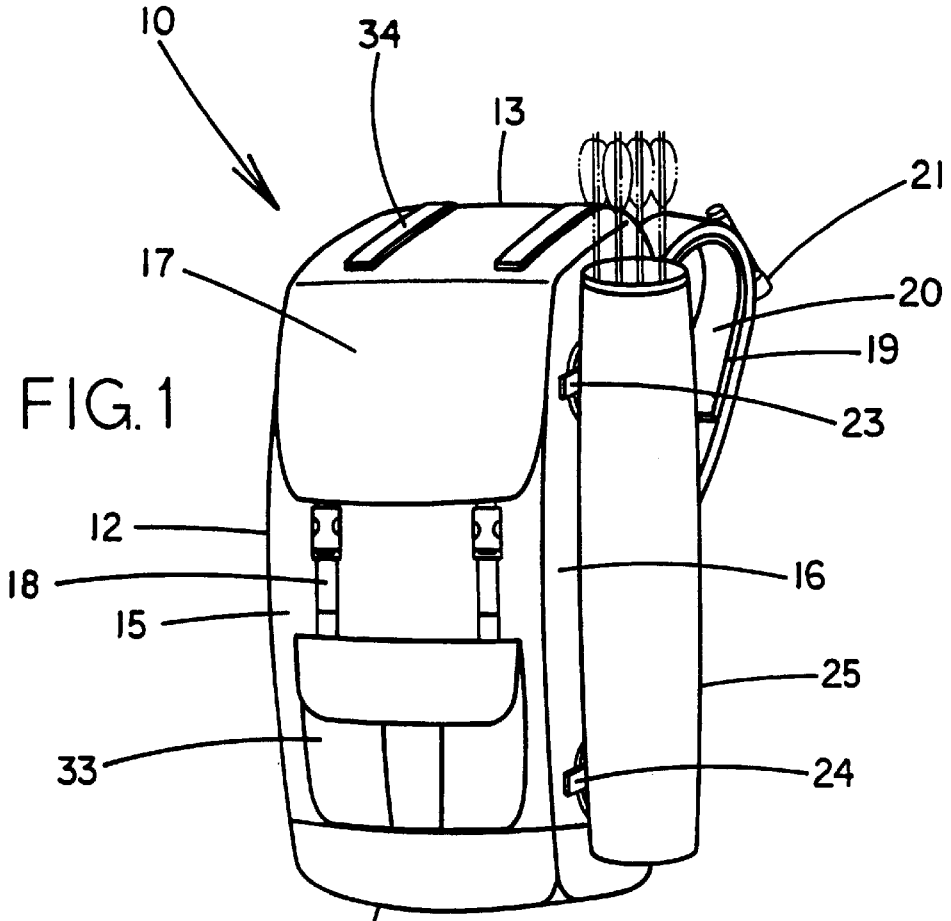
FIG. 1 is a schematic front perspective view of a new backpack according to the present invention.
Figure 2:
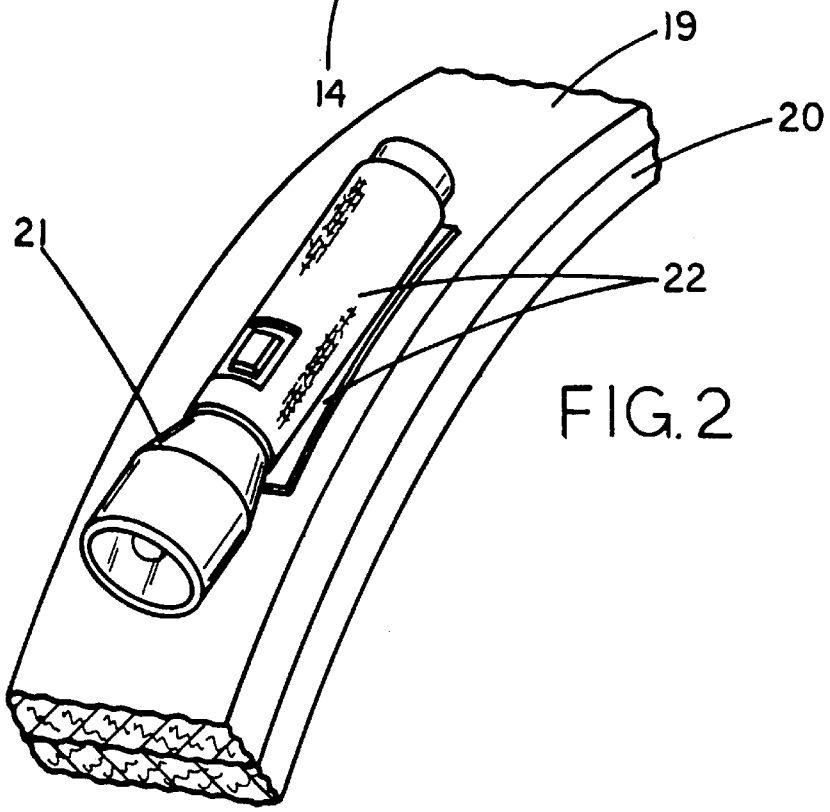
FIG. 2 is a schematic partial sectional view of a shoulder strap of the present invention.
Figure 3:
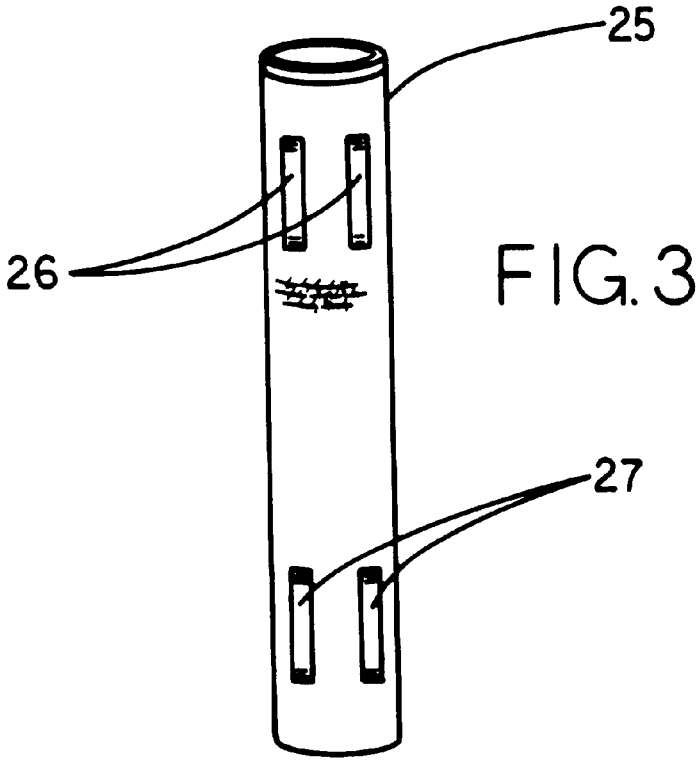
FIG. 3 is a schematic perspective view of the quiver of the present invention.
Figure 4:
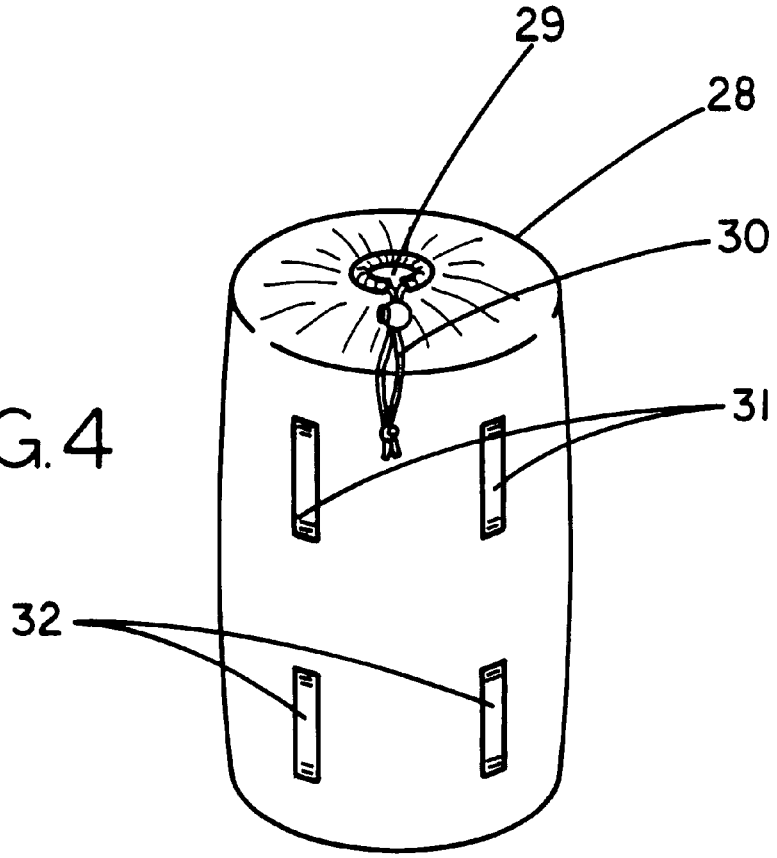
FIG. 4 is a schematic perspective view of the gear bag of the present invention.

With reference now to the drawings, and in particular to FIGS. 1 through 4 thereof, a new backpack embodying the principles and concepts of the present invention and generally designated by the reference numeral 10 will be described.

As best illustrated in FIGS. 1 through 4, the backpack 10 generally comprises a main compartment 12 with a pair of shoulder straps. A flashlight 21 is detachably attached to one of the shoulder straps 19. A quiver 25 is detachably attached to one of the sides 16 of the main compartment 12. A gear bag 28 is detachably attached to another side of the main compartment 12.

In closer detail, the main compartment 12 has a top, a bottom, a front 15, a back and a pair of sides. A lower pouch 33 is coupled to the front 15 of the main compartment 12. The lower pouch 33 is positioned towards the bottom 14 of the main compartment 12. The top 13 of the main compartment 12 has a top flap 17 covering a top opening into the main compartment 12. Preferably, the top flap has a pair of spaced apart resiliently elastic loops 34 designed for holding additional gear to the top flap 17 such as a bed roll. One end of each of a pair of top flap straps 18 is coupled to the front 15 of the main compartment 12 between the lower pouch and the top 13 of the main compartment 12. The other end of each of the top flap straps 18 is detachably attached to the free edge of the top flap 17 to hold the top flap 17 over the top opening of the main compartment. Preferably, a detachable fastener detachably attaches the other ends of the top flap straps to the free edge of the top flap.

A pair of shoulder straps 19 are attached to the back of the main compartment 12. Preferably, each of the shoulder straps 19 has a layer of padding 20 for added comfort. A flashlight 21 is detachably attached to one of the shoulder straps 19. Preferably, a hook and loop fastener 22 detachably attached the flashlight 21 to the one shoulder strap 19.

Each of the sides 16 of the main compartment 12 has a pair of gear straps 23,24 coupled thereto. Each gear strap has a free end that is detachably attachable to the associated side 16 of the main compartment 12. One of the gear straps 23 of each side of the main compartment 12 is positioned towards the top 13 of the main compartment 12 while the other gear strap 24 of each side of the main compartment 12 is positioned towards the bottom 14 of the main compartment 12.

A quiver is included having an opening at its top for holding arrows in the quiver. The quiver has first and second pairs of spaced apart quiver loops 26,27. The first pair of the quiver loops 26 are positioned towards the top of the quiver while the second pair of the quiver loops 27 are positioned towards the bottom 14 of the quiver. In use, the gear straps 23,24 of one of the sides of the main compartment 12 are looped through the pairs of quiver loops 26,27 of the quiver 25 such that the quiver 25 is detachably attached to that side 16 of the main compartment 12. In particular, one of the gear straps 23 is looped through the first pair of the quiver loops 26 while the other gear strap 24 is looped through the second pair of the quiver loops 27.

A gear bag 28 for carrying additional gear is preferably also provided. The gear bag 28 has an interior and an opening 29 into the interior of the gear bag 28. The gear bag preferably has a draw string 30 with a toggle lock for permitting selective closing the opening of the gear bag 28. Ideally, the interior of the gear bag 28 has a substantially water impermeable lining such as a plastic lining. The gear bag 28 has first and second pairs of spaced apart bag loops 31,32. In use, the gear straps 23,24 of the other side of the main compartment 12 is looped through the pairs of bag loops 31,32 of the gear bag 28 such that the gear bag 28 is detachably attached to the other side of the main compartment 12. Like the attachment of the quiver, one of the gear straps of the other side of the main compartment is looped through the first pair of the bag loops 31 while the other gear strap of the other side of the main compartment 12 is looped through the second pair of the gear loops 32.

In an ideal illustrative embodiment, the main compartment 12 has a length defined between the top and bottom 14 of the main compartment 12 greater than about 20 inches. In this illustrative embodiment, the main compartment 12 has a width defined between the sides of the main compartment 12 greater than about 14 inches and a thickness defined between the front and back of the main compartment 12 greater than about 6 inches. The quiver has a length defined between the top and bottom of the quiver which is preferably about equal to the length of the main compartment 12. Ideally, the length of the quiver is about 20 inches. The quiver has a width which is preferably about equal to the thickness of the main compartment 12. In this ideal illustrative embodiment, the lower pouch has a height defined between the top and bottom 14 of the main compartment 12 of about 6 inches and a width defined between the sides of the main compartment 12 of about 8 inches.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification arc intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A backpack, comprising:

a main compartment having a top, a bottom, a front, a back and a pair of sides;

a pair of shoulder straps being attached to said back of said main compartment;

a flashlight being detachably attached to one of said shoulder straps;

a quiver having a top and a bottom, said top of said quiver having an opening for holding arrows in said quiver;

said quiver being detachably attached to one of said sides of said main compartment;

a gear bag, said gear bag having an interior and an opening into the interior of said gear bag; and said gear bag being detachably attached to another side of said main compartment;

wherein said top of said main compartment has a top flap covering a top opening into the main compartment, said top flap having a free edge;

wherein said top flap has a pair of spaced apart resiliently elastic loops wherein each of said sides of said main compartment has a pair of gear straps coupled thereto, each gear strap having a free end detachably attached to the associated side of said main compartment, one of said gear straps of each side of said main compartment being positioned adjacent said top of said main compartment, another of said gear straps of each side of said main compartment being positioned adjacent said bottom of said main compartment.

2. The backpack of claim 1, further comprising a lower pouch being coupled to said front of said main compartment, said lower pouch being positioned towards said bottom of said main compartment.

3. The backpack of claim 1, further comprising a pair of top flap straps each having a pair of ends, one of said ends of said top flap straps being coupled to said front of said main compartment, another of said ends of each of said top flap straps being detachably attached to said free edge of said top flap.

4. The backpack of claim 1, wherein said quiver has first and second pairs of spaced apart quiver loops, said first pair of said quiver loops being positioned towards said top of said quiver, said second pair of said quiver loops being positioned towards said bottom of said quiver, wherein said gear straps of one of said sides of said main compartment are looped through said pairs of quiver loops of said quiver such that said quiver is detachably attached to one of said sides of said main compartment.

5. The backpack of claim 1, wherein said gear bag having first and second pairs of spaced apart bag loops, said gear straps of another of said sides of said main compartment being looped through said pairs of bag loops of said gear bag such that said gear bag is detachably attached to said other sides of said main compartment.

6. A backpack, comprising:

a main compartment having a top, a bottom, a front, a back and a pair of sides;

a lower pouch being coupled to said front of said main compartment, said lower pouch being positioned towards said bottom of said main compartment;

said top of said main compartment having a top flap covering a top opening into the main compartment, said top flap having a free edge;

said top flap having a pair of spaced apart resiliently elastic loops;

a pair of top flap straps each having a pair of ends, one of said ends of said top flap straps being coupled to said front of said main compartment, said one ends of said top flap straps being positioned between said lower pouch and said top of said main compartment, another of said ends of each of said top flap straps being detachably attached to said free edge of said top flap, wherein each said other end of said top flap straps has a detachable fastener for detachably attaching said other ends of said top flap straps to said free edge of said top flap;

a pair of shoulder straps being attached to said back of said main compartment;

a flashlight being detachably attached to one of said shoulder straps, wherein a hook and loop fastener detachably attached said flashlight to said one shoulder strap;

each of said sides of said main compartment having a pair of gear straps coupled thereto, each gear strap having a free end detachably attached to the associated side of said main compartment, one of said gear straps of each side of said main compartment being positioned adjacent said top of said main compartment, another of said gear straps of each side of said main compartment being positioned adjacent said bottom of said main compartment;

a quiver being generally cylindrical and having a top and a bottom, said top of said quiver having an opening for holding arrows in said quiver;

said quiver having first and second pairs of spaced apart quiver loops, said first pair of said quiver loops being positioned towards said top of said quiver, said second pair of said quiver loops being positioned towards said bottom of said quiver;

said gear straps of one of said sides of said main compartment being looped through said pairs of quiver loops of said quiver such that said quiver is detachably attached to one of said sides of said main compartment, one of said gear straps of said one side of said main compartment being looped through said first pair of said quiver loops, another of said gear straps of said one side of said main compartment being looped through said second pair of said quiver loops;

a gear bag, said gear bag having an interior and an opening into the interior of said gear bag, a draw string permitting selective closing said opening of said gear bag, wherein said interior of said gear bag has a substantially water impermeable lining; and said gear bag having first and second pairs of spaced apart bag loops, said gear straps of another of said sides of said main compartment being looped through said pairs of bag loops of said gear bag such that said gear bag is detachably attached to said other sides of said main compartment, one of said gear straps of said other side of said main compartment being looped through said first pair of said bag loops, another of said gear straps of said other side of said main compartment being looped through said second pair of said gear loops of said gear bag.

7. A backpack, comprising:

a main compartment having a top, a bottom, a front, a back and a pair of sides;

a pair of shoulder straps being attached to said back of said main compartment;

a flashlight being detachably attached to one of said shoulder straps;

a quiver having a top and a bottom, said top of said quiver having an opening for holding arrows in said quiver;

said quiver being detachably attached to one of said sides of said main compartment;

a gear bag, said gear bag having an interior and an opening into the interior of said gear bag; and said gear bag being detachably attached to another side of said main compartment;

wherein each of said sides of said main compartment has a pair of gear straps coupled thereto, each gear strap having a free end detachably attached to the associated side of said main compartment, one of said gear straps of each side of said main compartment being positioned adjacent said top of said main compartment, another of said gear straps of each side of said main compartment being positioned adjacent said bottom of said main compartment.

8. The backpack of claim 7, further comprising a lower pouch being coupled to said front of said main compartment, said lower pouch being positioned towards said bottom of said main compartment.

9. The backpack of claim 7, wherein said top of said main compartment has a top flap covering a top opening into the main compartment, said top flap having a free edge.

10. The backpack of claim 9, wherein said top flap has a pair of spaced apart resiliently elastic loops.

11. The backpack of claim 7, further comprising a pair of top flap straps each having a pair of ends, one of said ends of said top flap straps being coupled to said front of said main compartment, another of said ends of each of said top flap straps being detachably attached to said free edge of said top flap.

12. The backpack of claim 7, wherein said quiver has first and second pairs of spaced apart quiver loops, said first pair of said quiver loops being positioned towards said top of said quiver, said second pair of said quiver loops being positioned towards said bottom of said quiver, wherein said gear straps of one of said sides of said main compartment are looped through said pairs of quiver loops of said quiver such that said quiver is detachably attached to one of said sides of said main compartment.

13. The backpack of claim 7, wherein said gear bag has first and second pairs of spaced apart bag loops, said gear straps of another of said sides of said main compartment being looped through said pairs of bag loops of said gear bag such that said gear bag is detachably attached to said other sides of said main compartment.

* * * * *